US008618901B2

(12) United States Patent
Morisaki

(10) Patent No.: US 8,618,901 B2
(45) Date of Patent: Dec. 31, 2013

(54) POWER ACQUISITION DEVICE AND POWER ACQUISITION METHOD

(75) Inventor: Mitsunori Morisaki, Tokyo (JP)

(73) Assignee: NEC Corporation, Tokyo (JP)

( * ) Notice: Subject to any disclaimer, the term of this patent is extended or adjusted under 35 U.S.C. 154(b) by 1054 days.

(21) Appl. No.: 12/600,385

(22) PCT Filed: May 16, 2008

(86) PCT No.: PCT/JP2008/059042
§ 371 (c)(1),
(2), (4) Date: Nov. 16, 2009

(87) PCT Pub. No.: WO2008/140130
PCT Pub. Date: Nov. 20, 2008

(65) Prior Publication Data

US 2010/0148906 A1 Jun. 17, 2010

(30) Foreign Application Priority Data

May 16, 2007 (JP) ..... 2007-130427

(51) Int. Cl.
*H01F 17/04* (2006.01)
*H01F 17/06* (2006.01)
*H01F 27/28* (2006.01)
*H01F 27/24* (2006.01)

(52) U.S. Cl.
USPC ..... 336/221; 336/178; 336/229; 336/233

(58) Field of Classification Search
USPC ..... 336/178, 221, 229, 233
See application file for complete search history.

(56) References Cited

U.S. PATENT DOCUMENTS 6,246,183 B1 * 6/2001 Buonavita ..... 315/248
2003/0062851 A1 * 4/2003 Shaffer ..... 315/248

FOREIGN PATENT DOCUMENTS

JP 7-245890 A 9/1995
JP 8-23335 A 1/1996
JP 8-203324 A 8/1996
JP 11-97730 A 4/1999
JP 2001251238 A 9/2001
JP 2003309017 A 10/2003

(Continued)

OTHER PUBLICATIONS

International Search Report for PCT/JP2008/059042 mailed Jun. 24, 2008.

(Continued)

*Primary Examiner* — Tsz Chan

(57) ABSTRACT

A power acquisition device fixed to an illuminating device having a fluorescent tube and a reflective plate so as to acquire power from a magnetic field generated by an alternating current flowing through the fluorescent tube by electromagnetic induction. The power acquisition device is fixed so as to surround the fluorescent tube and at least one of the thickness in the direction perpendicular to the surface of the fluorescent tube and the length in the direction parallel to the length direction of the fluorescent tube is non-uniformly. Assuming that the area where the reflective plate exists in the direction perpendicular to the surface of the fluorescent tube is a first area, and the area where the reflective plate does not exist in the direction perpendicular to the surface of the fluorescent tube is a second area, at least one of the thickness in the direction perpendicular to the surface of the fluorescent tube and the length in the direction parallel to the length direction of the fluorescent tube is non-uniformly in the first and second areas.

14 Claims, 10 Drawing Sheets

(56) References Cited

FOREIGN PATENT DOCUMENTS

| | | | | |
|---|---|---|---|---|
| JP | 2004134681 | A | | 4/2004 |
| JP | 2004191975 | A | | 7/2004 |
| JP | 3709828 | B2 | | 8/2005 |
| JP | 2005354888 | A | | 12/2005 |
| JP | 2007012536 | A | * | 1/2007 |
| WO | 2007074724 | A | | 7/2007 |
| WO | 2007074849 | A | | 7/2007 |

OTHER PUBLICATIONS

NEC, Research Planning Division, Strategic Planning Group "Power supply technique for acquiring power from fluorescent lamp by eletromagnetic induction has been developed" Feb. 9, 2006, NEC Corporation [searched on Apr. 26, 2007], Internet <URL: http://www.nec.co.jp/press/ja/0602/0903.html>. See Non-Patent doc 1 on p. 1, paragraph [0003] of translated Specification for explanation of relevance.

* cited by examiner

POWER ACQUISITION DEVICE AND POWER ACQUISITION METHOD

This application is the National Phase of PCT/JP2008/059042, filed May 16, 2008, which is based upon and claims the benefit of priority from the Japanese Patent Application No. 2007-130427, filed on May 16, 2007, the entire contents of which are incorporated herein by reference.

TECHNICAL FIELD

The present invention relates to a power acquisition device and a power acquisition method and, more particularly, to a power acquisition device and a power acquisition method that acquire power from an illuminating device. This application is based upon and claims the benefit of priority from the Japanese Patent Application No. 2007-130427, filed on May 16, 2007, the entire contents of which are incorporated herein by reference.

BACKGROUND ART

In recent years, as a method for acquiring power from an illuminating device, a method for acquiring power by utilizing a magnetic field generated from a fluorescent tube of the illuminating device having the fluorescent tube and a reflective plate has been developed as disclosed in Non-Patent Document 1.

Such a power acquisition method and device that convert a magnetic field to an electric current are likely to be connected to various power consuming nodes and, therefore, a power acquisition device capable of acquiring a required power needs to be designed and applied.

Non-Patent Document 1: NEC, Research Planning Division, Strategic Planning Group "Power supply technique for acquiring power from fluorescent lamp by electromagnetic induction has been developed" Feb. 9, 2006, NEC Corporation [searched on Apr. 26, 2007], Internet <URL: http://www.nec.co.jp/press/ja/0602/0903. html>.

DISCLOSURE OF THE INVENTION

Problems To Be Solved By the Invention

As a power acquisition device relating to the present invention, a power acquisition device provided with a core (magnetic body) and a coil wound around the core can be taken.

This power acquisition device may be covered by a cover so as to prevent the core and coil from being seen directly from the outside.

Further, a space may be provided or not provided between the core and coil and the cover in the power acquisition device.

Since the cross-section of a fluorescent tube in the direction perpendicular to the surface of the fluorescent tube is a circle, a commonly-used toroidally-shaped core may be used as the core of the power acquisition device.

Therefore, when the toroidally-shaped core is used in the power acquisition device, the power acquisition device may have also a toroidal shape.

There are the following four parameters for designing and determining the amount of power to be acquired in the power acquisition device using the toroidally-shaped core: core's relative magnetic permeability, loss coefficient, number of turns of a secondary coil, core length, and core thickness.

An example of the above power acquisition device is illustrated in FIG. 1. FIG. 2 is a cross-sectional view of an illuminating device including the power acquisition device, and FIG. 3 is a plan view of the illuminating device as viewed from a fluorescent tube side.

In the power acquisition device illustrated in FIG. 1, a length La11 of a core (magnetic body) 2101 is the core length in the direction parallel to the length direction of a fluorescent tube, and a thickness Da11 of the core is the core length in the direction perpendicular to the surface of the fluorescent tube. A coil 2102 is wound around a part of the core 2101.

As to the parameters described above, the higher the relative magnetic permeability becomes, the larger the amount of power to be acquired becomes, and the smaller the loss coefficient becomes, the larger the amount of power to be acquired becomes.

Further, a core to be used is determined with the price in mind. The number of turns does not depend on the amount of power to be acquired.

That is, in order to design and determine the amount of power to be acquired in the power acquisition device, parameters of the core length and core thickness need to be designed and determined.

However, as illustrated in FIG. 2 illustrating a cross-sectional view of the illuminating device taken in the direction perpendicular to the surface of a fluorescent lamp, the thickness Da11 of a power acquisition device 2203 is restricted by a space required between a fluorescent tube 2202 and a reflective plate 2201. The power acquisition device 2203 is constituted by the coil 2102 and core 2101.

That is, the amount of power to be acquired in the power acquisition device using a toroidally-shaped core has been designed and determined based on only the core length.

As illustrated in FIG. 3, the power acquisition device 2203 is installed so as to surround a part of the fluorescent tube 2202 in the length direction thereof.

Accordingly, as the length of the power acquisition device is increased, the illuminance becomes lower, with the result that the original function of the fluorescent tube as an illuminating device cannot be fulfilled.

The present invention has been made in view of the above problems, and an object thereof is to achieve a power acquisition device and method capable of preventing the luminance from being lowered even when the length of the power acquisition device is increased and thereby fulfilling the original function as an illuminating device.

Means For Solving the Problems

According to an aspect of the present invention, there is provided a power acquisition device to be fixed to an illuminating device having a fluorescent tube and a reflective plate so as to acquire power from a magnetic field generated by an alternating current flowing through the fluorescent tube by electromagnetic induction, wherein the power acquisition device is fixed so as to surround the fluorescent tube, and at least either the thickness in the direction perpendicular to the surface of the fluorescent tube or the length in the direction parallel to the length direction of the fluorescent tube is non-uniformly.

According to another aspect of the present invention, there is provided a power acquisition method of a power acquisition device to be fixed to an illuminating device having a fluorescent tube and a reflective plate so as to acquire power from a magnetic field generated by an alternating current flowing through the fluorescent tube by electromagnetic induction, wherein the power acquisition device is fixed so as to surround the fluorescent tube, and at least either the thickness in the direction perpendicular to the surface of the fluorescent tube or the length in the direction parallel to the length direction of the fluorescent tube is non-uniformly.

Advantages of the Invention

According to the present invention, there can be provided a power acquisition device capable of preventing the luminance from being lowered even when the length of the power acquisition device is increased and thereby fulfilling the original function as an illuminating device.

EXPLANATION OF REFERENCE SYMBOLS

101, 301, 401, 501, 601, 701, 801, 901, 1100, 1200: Cores
602, 702, 703: Coils
Db1, Db2: Core thickness
Lb1, Lb2: Core length
Db11, Db12: Core thickness
Lb3, Lb31, Lb32, Lb41 to Lb44: Core length
Db21, Db22, Db23: Core thickness
201: Reflective plate
202: Fluorescent tube
1001: Reflective plate
1002: Fluorescent tube
1300: Reflective plate
1301: Fluorescent tube

BEST MODE FOR CARRYING OUT THE INVENTION

Exemplary embodiments of a power acquisition device according to the present invention will be described below with reference to the accompanying drawings.

[First Exemplary Embodiment]

Figure 1:
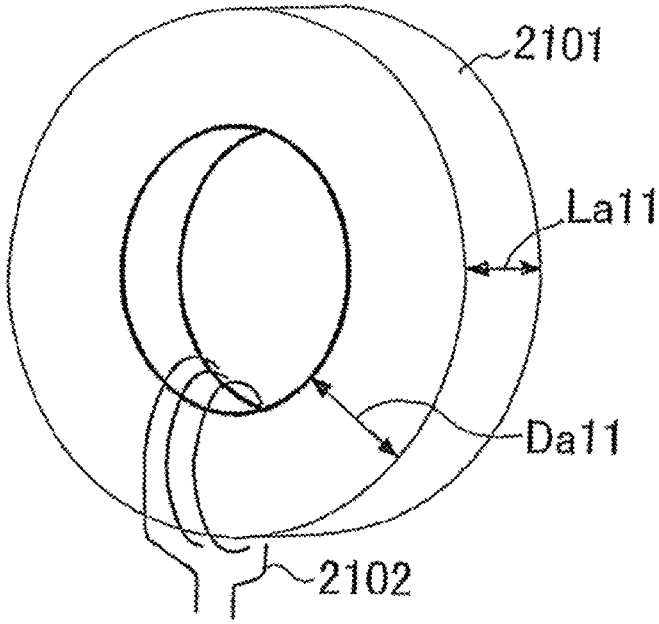
FIG. 1 is a view illustrating an example of a power acquisition device as a background art of the present invention.
Figure 2:
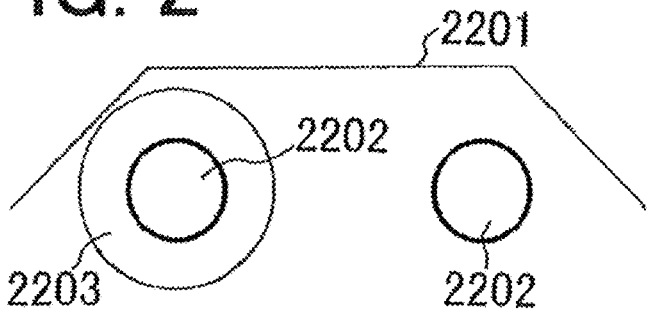
FIG. 2 is a cross-sectional view of an illuminating device provided with the power acquisition device as a background art taken in the direction perpendicular to the surface of a fluorescent tube.
Figure 3:
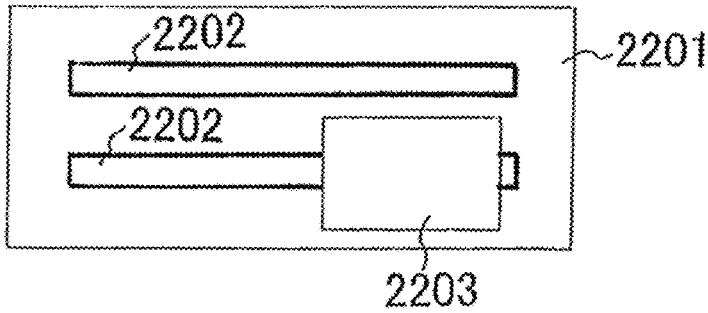
FIG. 3 is a plan view of the illuminating device provided with the power acquisition device as a background art as viewed from the fluorescent tube side.
Figure 4:
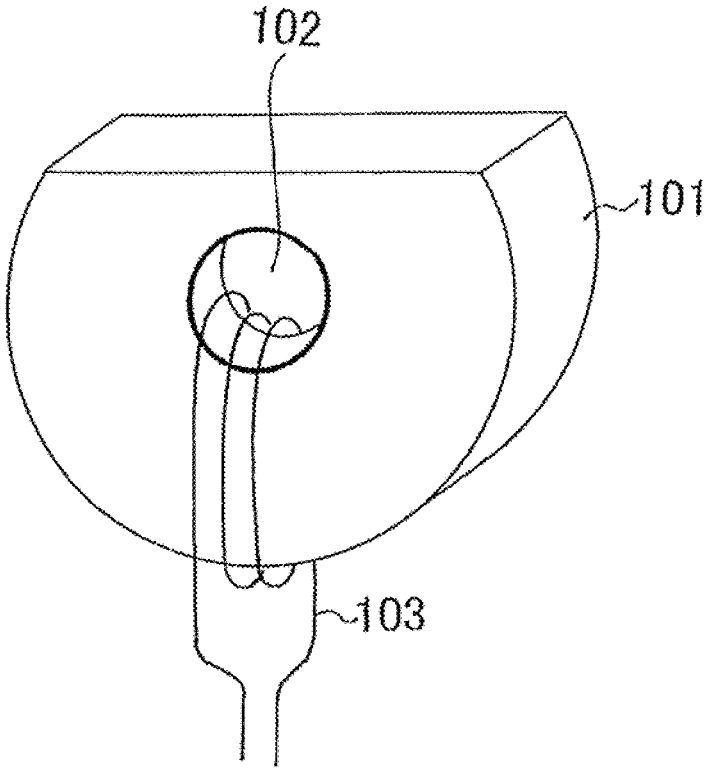
FIG. 4 is a view illustrating a power acquisition device according to a first exemplary embodiment of the present invention.
Figure 5:
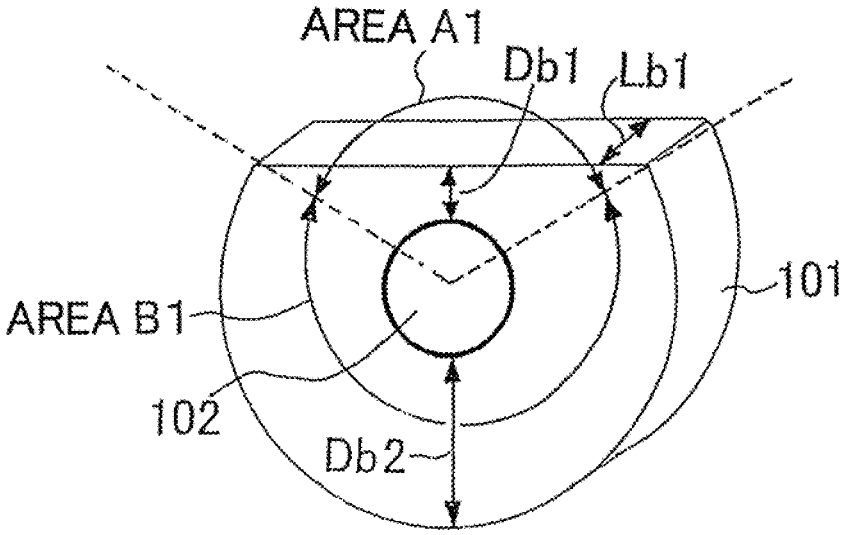
FIG. 5 is a view illustrating a core of the power acquisition device according to the first exemplary embodiment of the present invention.

First, as an example of a power acquisition device according to the first exemplary embodiment of the present invention, an example of a shape of the power acquisition device is illustrated in FIG. 4. FIG. 5 illustrates a shape of a core 101. The present exemplary embodiment represents an example in which the thickness of the power acquisition device in the direction perpendicular to the surface of a fluorescent tube is non-uniformly.

Figure 7:
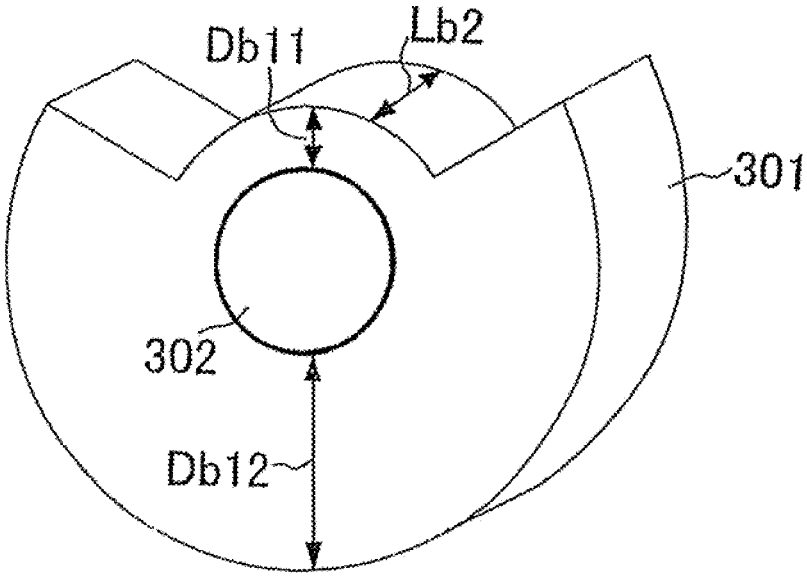
FIG. 7 is a view illustrating a modification of the core of the power acquisition device according to the first exemplary embodiment of the present invention.
Figure 8:
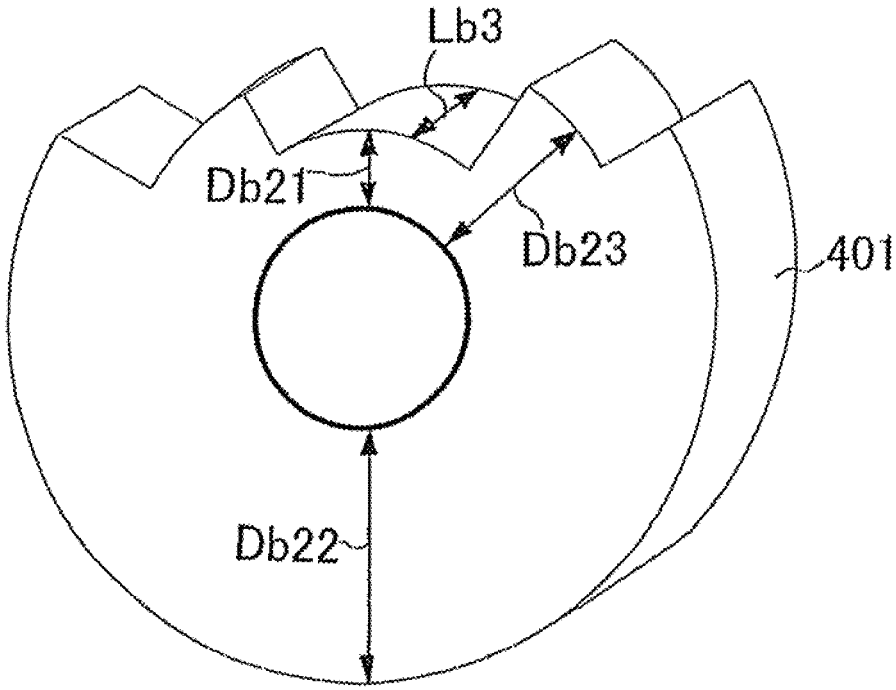
FIG. 8 is a view illustrating another modification of the core of the power acquisition device according to the first exemplary embodiment of the present invention.
Figure 9:
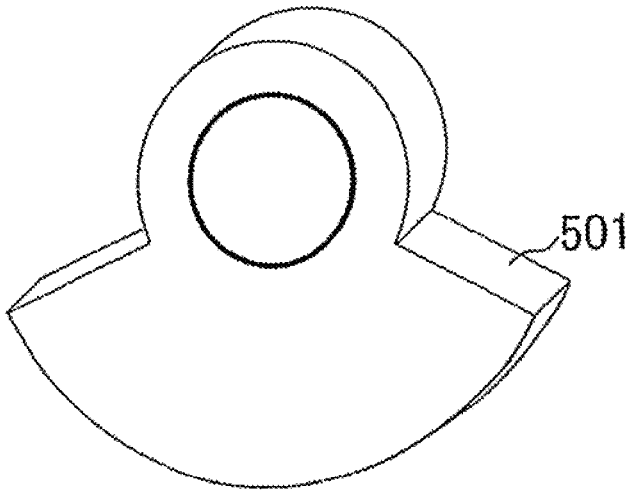
FIG. 9 is a view illustrating a still another modification of the core of the power acquisition device according to the first exemplary embodiment of the present invention.

The power acquisition device has a shape in which a coil 103 is wound around the core 101. The core and coil may be covered by a cover member or may be resin-molded. The outer shape of the power acquisition device illustrated in FIG. 4 reflects the core shape. However, the outer shape of the power acquisition device need not correspond to the core shape. For example, even when the core has a shape as illustrated in FIG. 7, FIG. 8, or FIG. 9, the power acquisition device can be made to have a shape as illustrated in FIG. 5 depending on the shape of a cover member to be used.

Figure 6:
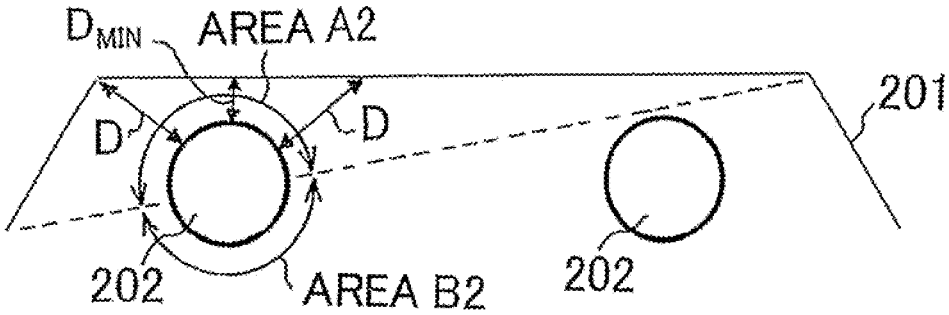
FIG. 6 is a view illustrating an illuminating device used for the power acquisition device according to the first exemplary embodiment of the present invention.

The power acquisition device illustrated in FIG. 4 can be attached to an illuminating device as illustrated in FIG. 6 having a reflective plate 201 and a fluorescent tube 202. The power acquisition device is attached to the illuminating device such that the fluorescent tube 202 is inserted through a hollow portion 102 of the core 101 so as to allow the core to surround the fluorescent tube. In this configuration, power is acquired from the coil 103 by electromagnetic induction based on a magnetic field generated by an alternating current flowing through the fluorescent tube 202. The power acquisition device illustrated in FIG. 4 has an upper portion formed in accordance with the shape of the reflective plate illustrated in FIG. 6 and is formed into a columnar body obtained by cutting a part of the side surface of the cylinder. A cylindrical opening portion through which the fluorescent tube is inserted has been formed in the power acquisition device.

In the lower portion (area B2) of FIG. 6 where the reflective plate does not exist in the direction perpendicular to the surface of the fluorescent tube, the thickness of the power acquisition device (i.e., thickness of the core) is Db2 (corresponding to D2). Further, of the entire surface portion (area A2) where the reflective plate exists in the direction perpendicular to the surface of the fluorescent tube, in a second surface portion (a third area obtained by subtracting an area A1 from the area A2) where the distance between the surface of the fluorescent tube and the reflective plate is not less than a predetermined distance D, the thickness of the power acquisition device is Db2. That is, in an area B1 obtained by adding the area B2 and an area (area A2-area A1) obtained by subtracting the area A1 from the area A2, the thickness of the power acquisition device is Db2. The area A2 corresponds to a first area, and area B2 corresponds to a second area. A thickness Db1 is a thickness (corresponding to a thickness D1) at the position in the area A1 at which the distance between the surface of the fluorescent tube and the reflective plate becomes minimum $D_{MIN}$ and is not more than the minimum distance $D_{MIN}$. The thickness Db2 is larger than the thickness Db1. The predetermined distance D is larger than the minimum distance $D_{MIN}$.

Further, of the entire surface portion (area A2) where the reflective plate exists in the direction perpendicular to the surface of the fluorescent tube, in a first surface portion (area A1) where the distance between the surface of the fluorescent tube and the reflective plate is less than the predetermined distance, the thickness of the power acquisition device is set in a range of from Db2 to Db1.

In FIG. 5, the fluorescent tube 202 is inserted through the hollow portion 102 of the core 101.

In the first exemplary embodiment, the hollow portion 102 of the core has a circular shape. It is desirable that the shape of the hollow portion be determined in accordance with the cross-sectional shape of the fluorescent tube 202.

The thickness Db2 of the core 101 in the second surface portion (area B1) is determined depending on the magnitude of the acquisition power to be required.

Although the thickness Db2 of the core 101 in the second surface portion (area B1) is set to a fixed value in this example, it may be non-uniformly.

The length (length Lb1 of the power acquisition device in the direction parallel to the length direction of the fluorescent tube) of the power acquisition device is determined with the allowable upper limit on the reduction in luminance. Further, although the coil 103 is wound around the core 101 four times in FIG. 4, the number of times of turns of the coil may be varied as required.

Thus, in the present exemplary embodiment, the thickness of the power acquisition device can be set larger than the minimum distance between the surface of the fluorescent tube and the reflective plate, so that the length of the power acquisition device in the direction parallel to the length direction of the fluorescent tube, which is required for acquiring the same power, can be reduced as compared with a conventional toroidally-shaped power acquisition device, allowing a power acquisition device capable of preventing illuminance degradation to be occurred.

Although the core illustrated in FIG. 5 is formed into a cylindrical body obtained by cutting a part of the side surface of the cylinder, in which a cylindrical opening portion through which the fluorescent tube is inserted has been formed, the cut portion may be formed into other shapes. For example, in a power acquisition device as illustrated in FIG. 7, the thickness of the power acquisition device in the area B1 is set to a fixed value of Db12 as in the case of FIG. 5, and the thickness thereof in the area A1 is set to a fixed value of Db11 (=Db1). That is, in FIG. 7, the cut portion is formed such that the same thickness is obtained in the area A1. The length Lb2 of the core of the power acquisition device illustrated in FIG. 7 is equal to the length Lb1.

As described above, the shape of the power acquisition device may be formed by combining two toroidally-shaped parts having the first thickness Db12 and second thickness Db11.

Further, as illustrated in FIG. 8, the shape of the power acquisition device may be formed by combining three toroidally-shaped parts having the same core length LB3 but having the different thicknesses of Db21, Db23, and Db22. It goes without saying that toroidally-shaped parts having four or more different thicknesses may be combined. That is, in FIG. 8, the cut portion is formed such that steps are formed in the area A1.

In both the exemplary embodiments illustrated in FIGS. 7 and 8, the thickness of the power acquisition device in the area B1 is set larger than the thickness thereof in the area A1.

Further, in the upper portion (area A1) of FIG. 6 restricted by the reflective plate, the thickness of the power acquisition device is set not more than the distance between the fluorescent tube and the reflective plate.

Further, as illustrated in FIG. 9 which is a modification of FIG. 7, a part of the core in the area B1 may have the same thickness as that in the area A1. Note that although only a core 301, a core 401, and a core 501 are illustrated in FIGS. 7 to 9, respectively, the coil is actually wounded around each of the cores as illustrated in FIG. 4.

Figure 10:
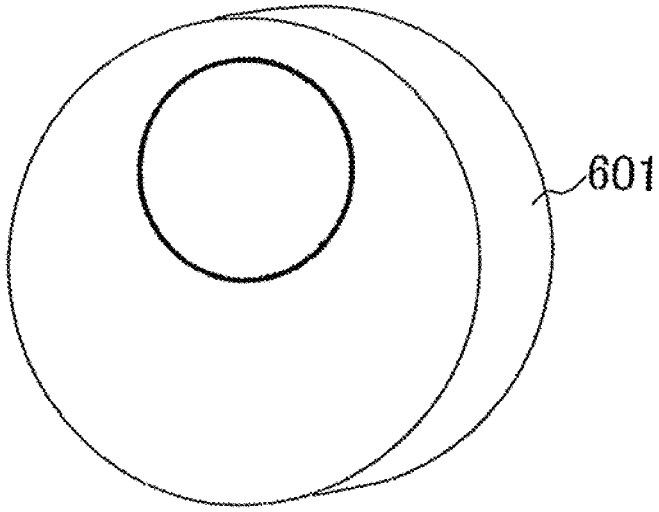
FIG. 10 is a view illustrating the shape of a core in which the opening portion thereof is eccentrically located from the center line of the core body.
Figure 11:
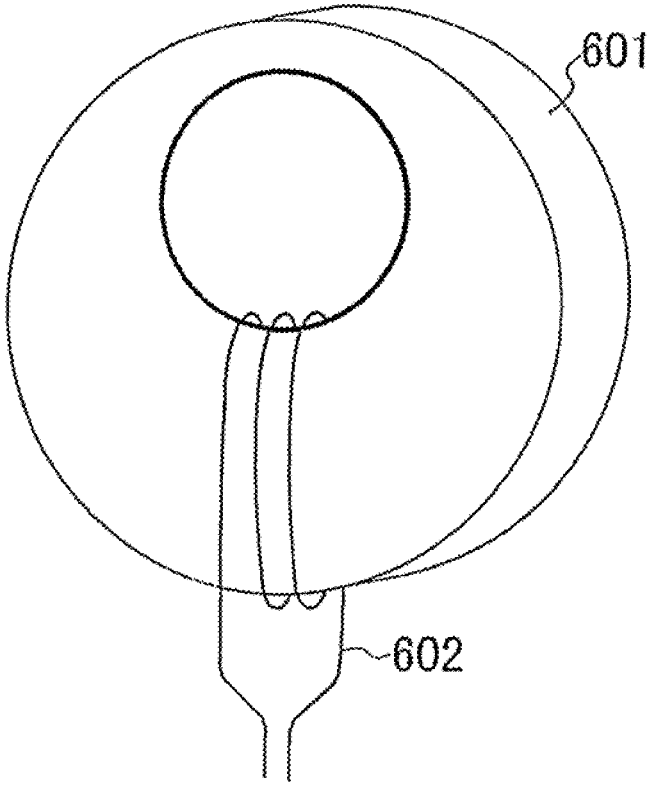
FIG. 11 is a view illustrating an exemplary embodiment of a power acquisition device using the core in which the opening portion thereof is eccentrically located from the center line of the core body.

Further, as illustrated in FIG. 10, a configuration may be employed in which a core 601 is formed into a cylindrical body having an opening portion through which the fluorescent tube is inserted and which is eccentrically located from the center line of the cylindrical body toward the area A1 side (on the side toward the position of the minimum distance $D_{MIN}$). FIG. 11 illustrates a power acquisition device in which a coil 602 is wound around the core 601. Although the coil 602 is wound around the core 601 four times in FIG. 11, the number of times of turns of the coil may be varied as required.

Further, although the thickness (core thickness) of the power acquisition device in the lower portion (area B2) where the reflective plate does not exist in the direction perpendicular to the surface of the fluorescent tube and an area obtained by subtracting the area A1 from the area A2 is set to a fixed value in the above examples, it may be non-uniformly.

Further, although the thickness of the power acquisition device in the area A1 is set equal to the distance between the surface of the fluorescent tube and the reflective plate in the example of FIG. 4, it may be set equal to or less than the distance between the surface of the fluorescent tube and the reflective plate.

Further, the power acquisition device employed in the present exemplary embodiment may have a configuration obtained by simply winding a coil directly around a core (magnetic body). Further, the coil and the core may be covered by a cover material.

A cable for power supply may be extended from a part of the present configuration.

[Second Exemplary Embodiment]

Figure 12:
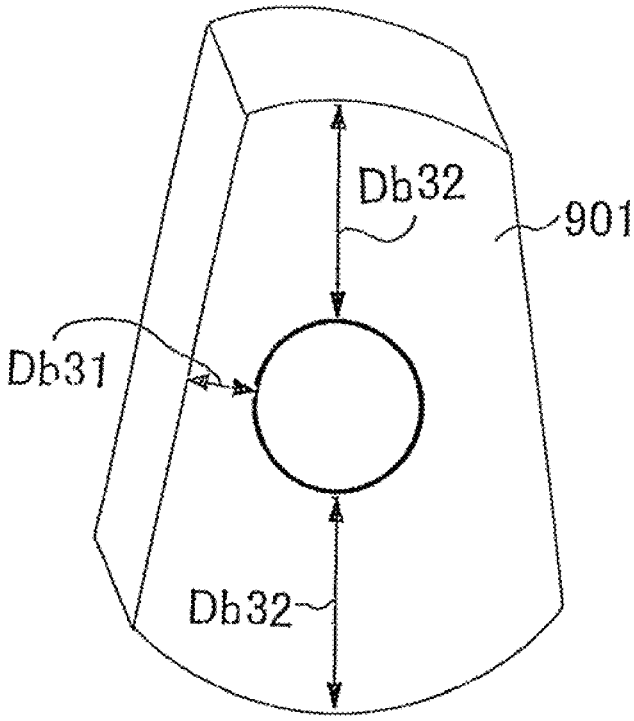
FIG. 12 is a view illustrating a core of a power acquisition device according to a second exemplary embodiment of the present invention.
Figure 13:
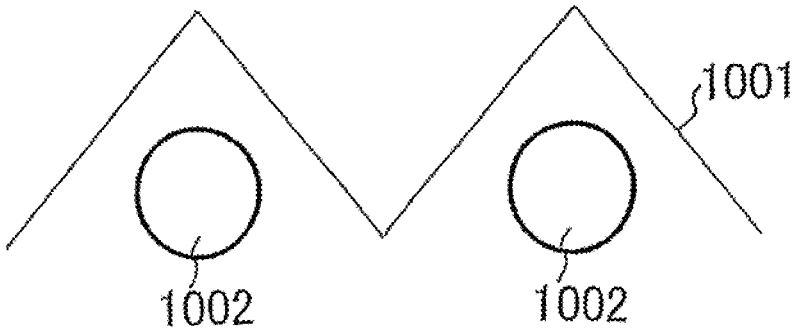
FIG. 13 is a view illustrating an illuminating device which the power acquisition device according to the second exemplary embodiment of the present invention is used.

Next, as a power acquisition device according to a second exemplary embodiment of the present invention, an example of a shape of the power acquisition device is illustrated in FIG. 12. The power acquisition device illustrated in FIG. 12 is attached to an illuminating device having a reflective plate having V-shaped concaves arranged in a zig-zag pattern as illustrated in FIG. 13. In the present exemplary embodiment, a core 901 has a columnar body having a side surface opposite to the V-shaped concave. As in the case of the first exemplary embodiment, the thickness of the power acquisition device according to the present exemplary embodiment in the direction perpendicular to the surface of the fluorescent tube is non-uniformly.

The thickness of the power acquisition device illustrated in FIG. 12 is a first thickness Db32 in the lower portion where a reflective plate 1001 does not exist in the direction perpendicular to the surface of the fluorescent tube. Further, the thickness of the power acquisition device is the first thickness Db32 in the upper portion where the reflective plate 1002 exists in the direction perpendicular to the surface of the fluorescent tube but the distance between the surface of the fluorescent tube and the reflective plate is not less than a predetermined value.

Further, in the area where the reflective plate 1001 exists in the direction perpendicular to the surface of the fluorescent tube and the distance between the surface of the fluorescent tube and the reflective plate is not more than a predetermined value, the thickness of the power acquisition device is set equal to the distance between the surface of the fluorescent tube and the reflective plate. The thickness of the power acquisition device at the portion at which the distance between the surface of the fluorescent tube and the reflective plate becomes a minimum is Db31.

Figure 14:
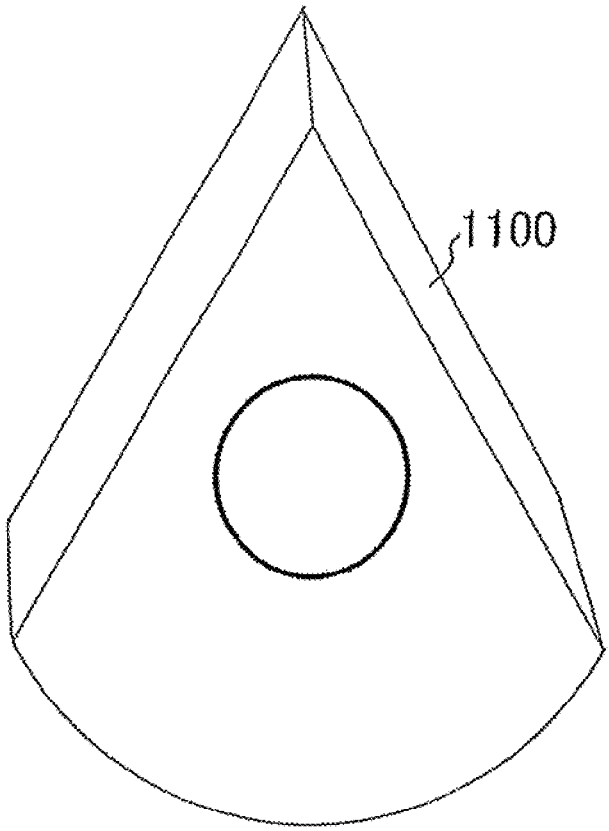
FIG. 14 is a view illustrating another exemplary embodiment of the core of the power acquisition device according to the second exemplary embodiment of the present invention.

Further, as a modification of the above second exemplary embodiment illustrated in FIG. 12, the power acquisition device may have a core having a shape tapered toward the upper end, as represented by a core 1100 of FIG. 14 in the case where the first thickness of the lower portion where the reflective plate does not exist in the direction perpendicular to the surface of the fluorescent tube is larger than the distance between the uppermost portion of the fluorescent tube 1002 of FIG. 12 and the reflective plate.

Although the core thickness is made equal between the lower portion where the reflective plate 1001 does not exist in the direction perpendicular to the surface of the fluorescent tube 1002 and the upper portion where the reflective plate 1002 exists in the direction perpendicular to the surface of the fluorescent tube 1002 but the distance between the surface of the fluorescent tube and the reflective plate is not less than a predetermined value, the thickness may differ from between the lower and upper portions.

Further, although the thickness of the power acquisition device is set equal to the distance between the surface of the fluorescent tube and the reflective plate in the area where the reflective plate 1001 exists in the direction perpendicular to the surface of the fluorescent tube 1002 and the distance between the surface of the fluorescent tube and the reflective plate is not more than a predetermined value in the above two examples (FIGS. 12 and 14), it may be set to a value less than the distance between the surface of the fluorescent tube and the reflective plate.

Although the power acquisition device whose outer shape is formed in accordance with the outer shape of the reflective plate as illustrated in FIG. 13 has been described in the present exemplary embodiment, the present invention is not limited to this. For example, in the case where the power acquisition device can be attached to the illuminating device without being restricted by the shape of the reflective plate, the shape of the power acquisition device according to the first exemplary embodiment may be adopted.

Further, as described in the first exemplary embodiment, the shape of the hollow portion of the power acquisition device is not limited to a circle but may be an ellipse or polygon.

Further, the power acquisition device employed in the present exemplary embodiment may have a configuration obtained by simply winding a coil directly around a core (magnetic body). Further, the coil and the core may be covered by a cover material.

A cable for power supply may be extended from a part of the present configuration.

[Third Exemplary Embodiment]

Figure 15:
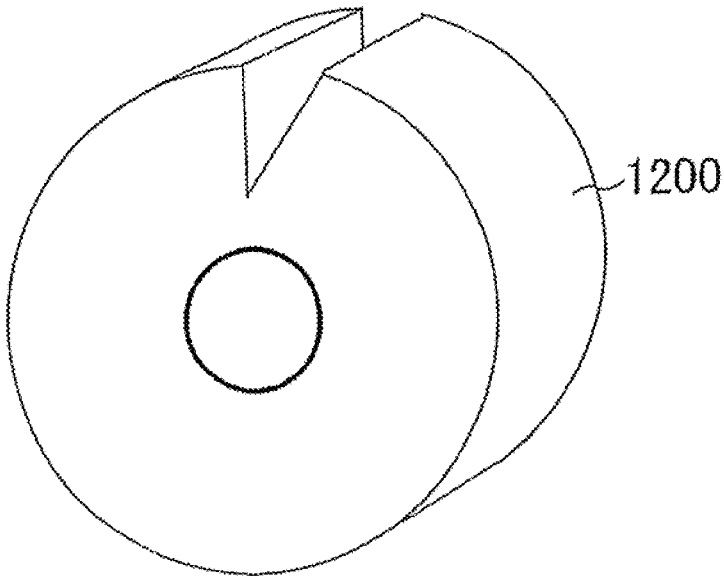
FIG. 15 is a view illustrating a core of a power acquisition device according to a third exemplary embodiment of the present invention.
Figure 16:
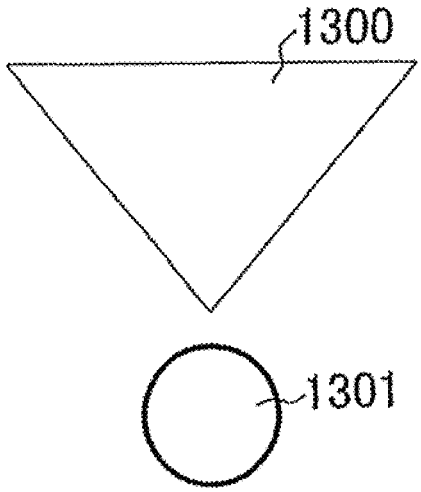
FIG. 16 is a view illustrating an illuminating device which the power acquisition device according to the third exemplary embodiment of the present invention is used.

Next, as a power acquisition device according to a third exemplary embodiment of the present invention, an example of a shape of the power acquisition device is illustrated in FIG. 15. The power acquisition device illustrated in FIG. 15 is attached to an illuminating device having a reflective plate having a V-shaped convex as illustrated in FIG. 16. As in the case of the first exemplary embodiment, the thickness of the power acquisition device according to the present exemplary embodiment in the direction perpendicular to the surface of the fluorescent tube is non-uniformly.

In the power acquisition device illustrated in FIG. 15, the lower portion where a reflective plate 1300 does not exist in the direction perpendicular to the surface of the fluorescent tube 1301 has a first thickness. Further, the area where the reflective plate 1300 exists in the direction perpendicular to the surface of the fluorescent tube 1301 but the distance between the surface of the fluorescent tube 1301 and the reflective plate is not less than a predetermined value has the first thickness.

Further, in the area where the reflective plate 1300 exists in the direction perpendicular to the surface of the fluorescent tube 1301 and the distance between the surface of the fluorescent tube 1301 and the reflective plate 1300 is not more than a predetermined value, the thickness of the power acquisition device is set equal to the distance between the surface of the fluorescent tube and the reflective plate. In this configuration, the core is formed into a shape having a groove opposite to the V-shaped convex.

Like the power acquisition device illustrated in FIG. 15, a power acquisition device that is not restricted by a reflective plate of FIG. 16 positioned above a fluorescent tube can be obtained.

Further, the core thickness in the lower portion where the reflective plate 1300 does not exist in the direction perpendicular to the surface of the fluorescent tube 1301 and the area where the reflective plate 1300 exists in the direction perpendicular to the surface of the fluorescent tube 1301 but the distance between the surface of the fluorescent tube 1301 and the reflective plate 1300 is not less than a predetermined value may be uniformly or non-uniformly.

Further, also in the third exemplary embodiment, although the thickness of the power acquisition device is set equal to the distance between the surface of the fluorescent tube and the reflective plate in the area where the reflective plate 1300 exists in the direction perpendicular to the surface of the fluorescent tube 1301 and where the distance between the surface of the fluorescent tube 1301 and the reflective plate 1300 is not more than a predetermined value, it may be set to a value less than the distance between the surface of the fluorescent tube and the reflective plate.

Although the power acquisition device whose outer shape is formed in accordance with the outer shape of the reflective plate as illustrated in FIG. 16 has been described in the present exemplary embodiment, the present invention is not limited to this. For example, in the case where the power acquisition device can be attached to the illuminating device without being restricted by the shape of the reflective plate, the shape of the power acquisition device according to the first and second exemplary embodiments may be adopted.

Further, as described in the first and second exemplary embodiments, the shape of the hollow portion of the power acquisition device is not limited to a circle but may be an ellipse or polygon.

Further, the power acquisition device employed in the present exemplary embodiment may have a configuration obtained by simply winding a coil directly around a core (magnetic body). Further, the coil and the core may be covered by a cover material.

A cable for power supply may be extended from a part of the present configuration.

[Fourth Exemplary Embodiment]

In the present exemplary embodiment, a configuration in which the length of the power acquisition device in the direction parallel to the length direction of the fluorescent tube is non-uniformly will be described.

Considering an illuminating device installed on the ceiling, light generated from the upper portion of the fluorescent tube reaches the floor after being reflected by a reflective plate, so that the light intensity becomes lower than that of light emitted from the lower portion of the fluorescent tube.

In view of this, the smaller the length of the lower portion of the power acquisition device positioned around the lower portion of the fluorescent tube, the less the luminance reduction occurs. On the other hand, it is desirable that the length of the upper portion of the power acquisition device be larger in order to prevent power reduction caused due to the reduction in the length of the lower portion of the power acquisition device. That is, assuming the area where the reflective plate exists in the direction perpendicular to the surface of the fluorescent tube is an area A2 and the area where the reflective plate does not exist in the direction perpendicular to the surface of the fluorescent tube is an area B2 in the illuminating device illustrated in FIG. 6, it is desirable that the length of the power acquisition device in the direction parallel to the length direction of the fluorescent tube in at least a part of the area A2 be larger than the maximum value of the length of the power acquisition device in the direction parallel to the length direction of the fluorescent tube in the area B2.

Figure 17:
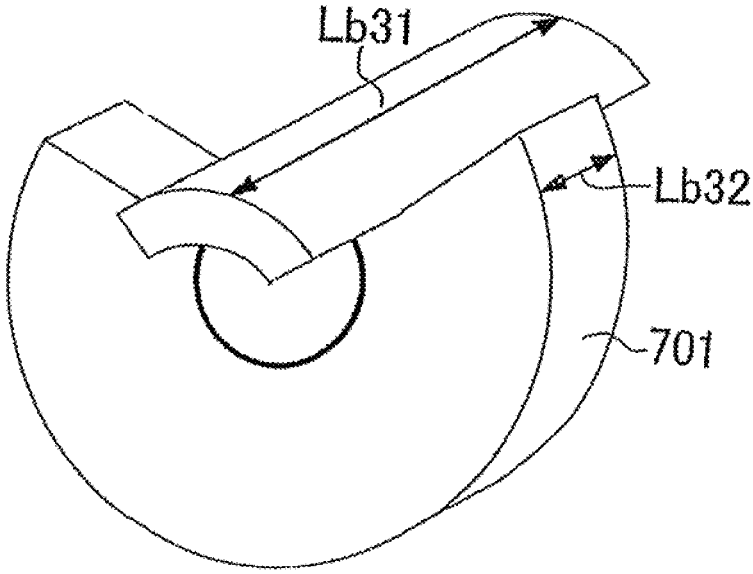
FIG. 17 is a view illustrating a core of a power acquisition device according to a fourth exemplary embodiment of the present invention.
Figure 18:
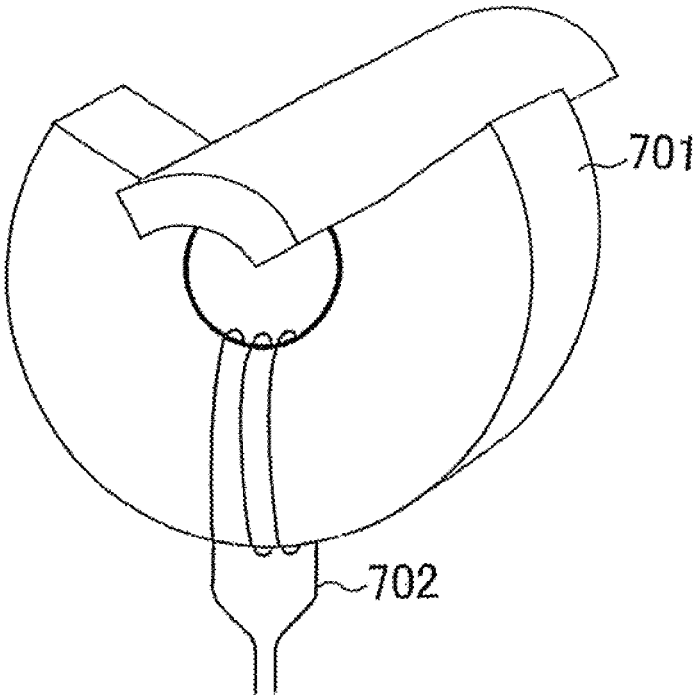
FIG. 18 is a view illustrating the power acquisition device according to the fourth exemplary embodiment of the present invention.
Figure 19:
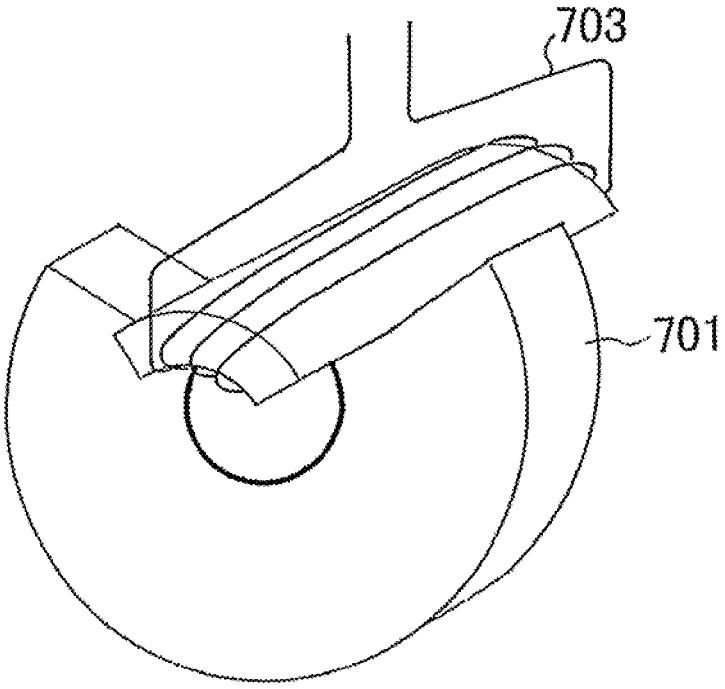
FIG. 19 is a view illustrating another example of the power acquisition device according to the fourth exemplary embodiment of the present invention.

That is, a configuration illustrated in FIG. 17 in which a length Lb 31 of the upper portion is larger than a length Lb32 of the lower portion is more desirable than the configuration represented in the above first to third exemplary embodiments in which the length of the power acquisition device is made uniform. FIG. 18 illustrates an example in which a coil 702 is wound around the lower portion of a core 701, and FIG. 19 illustrates an example in which a coil 703 is wound around the upper portion of the core 701. Although the coil 702 is wound around the core 701 four times in FIG. 18 and the coil 703 is wound around the core 701 four times in FIG. 19, the number of times of turns of the coil may be varied as required.

Figure 20:
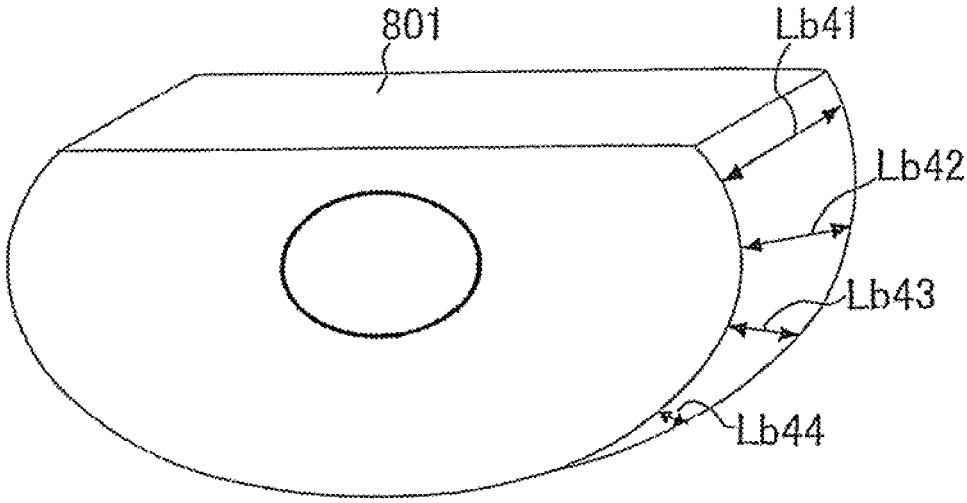
FIG. 20 is a view illustrating another example of the core of the power acquisition device according to the fourth exemplary embodiment of the present invention.

Further, as illustrated in FIG. 20, a configuration in which the length of the power acquisition device is continuously reduced from the upper portion toward the lower portion (length Lb41→length Lb42→length Lb43→length Lb44).

Although the hollow portion of the power acquisition device is formed into a circle in the present exemplary embodiment, it may be formed into an ellipse or polygon and not limited to a circle.

Further, as described in the first exemplary embodiment, the shape of the hollow portion of the power acquisition device is not limited to a circle but may be an ellipse or polygon.

Further, the power acquisition device employed in the present exemplary embodiment may have a configuration obtained by simply winding a coil directly around a core (magnetic body). Further, the coil and the core may be covered by a cover material.

A cable for power supply may be extended from a part of the present configuration.

Further, in the configuration illustrated in FIG. 20, the length of the power acquisition device in the direction parallel to the length direction of the fluorescent tube is non-uniformly and, at the same time, the thickness of the power acquisition device in the direction perpendicular to the surface of the fluorescent tube is non-uniformly. In this manner, it is possible to appropriately combine the configuration of first to third exemplary embodiments and the configuration of FIGS. 17 and 20.

Although the exemplary embodiments of the present invention have been described, it should be understood that the present invention can be practiced in various forms without departing from the spirit and scope of the invention as defined by the appended claims. Thus, the above exemplary embodiments are merely illustrative and should not be considered restrictive in any way. The scope of the present invention is defined by the appended claims and not restricted by the descriptions of the specification and abstract. Further, all variations and modifications which come within the equivalent range of the claims are embraced in the scope of the present invention.

The invention claimed is:

1. A power acquisition device to be fixed to an illuminating device having a fluorescent tube and a reflective plate so as to acquire power from a magnetic field generated by an alternating current flowing through the fluorescent tube by electromagnetic induction, wherein the power acquisition device is fixed to surround the fluorescent tube, and at least either a thickness of the power acquisition device in the direction perpendicular to the surface of the fluorescent tube or a length of the power acquisition device in the direction parallel to the length direction of the fluorescent tube is non-uniformly, and wherein when the area where the reflective plate exists in the direction perpendicular to the surface of the fluorescent tube is a first area; the area where the reflective plate does not exist in the direction perpendicular to the surface of the fluorescent tube is a second area; the minimum distance between the surface of the fluorescent tube and reflective plate in the first area is distance D3; and the thickness of the power acquisition device in the direction perpendicular to the surface of the fluorescent tube at the position at which the distance between the surface of the fluorescent tube and the reflective plate in the first area becomes minimum is thickness D1, the thickness D1 is smaller than the distance D3, and the thickness of the power acquisition device in the direction perpendicular to the surface of the fluorescent tube in at least a part of the second area is set to thickness D2 which is larger than the distance D3.

2. The power acquisition device according to claim 1, wherein the power acquisition device has a columnar body obtained by cutting a part of the side surface of the cylinder, in which an opening portion through which the fluorescent tube is inserted has been formed, and the cut portion is formed at an area including the position at which the distance between the surface of the fluorescent tube and the reflective plate in the first area becomes minimum.

3. The power acquisition device according to claim 2, wherein in the second area and a third area which is included in the first area and within which the distance between the surface of the fluorescent tube and the reflective plate is larger than the distance D3, the thickness of the power acquisition device in the direction perpendicular to the surface of the fluorescent tube is set to the distance D2.

4. The power acquisition device according to claim 2, wherein in the second area and a part of a third area which is included in the first area and within which the distance between the surface of the fluorescent tube and the reflective plate is larger than the distance D3, the thickness of the power acquisition device in the direction perpendicular to the surface of the fluorescent tube is set to the thickness D2, and in the remaining part of the third area which is included in the first area, the thickness of the power acquisition device in the direction perpendicular to the surface of the fluorescent tube is set to the thickness D1.

5. The power acquisition device according to claim 2, wherein the thickness of the power acquisition device in the direction perpendicular to the surface of the fluorescent tube in the first area is set to the thickness D1 which is smaller than the distance D3, the thickness of the power acquisition device in the direction perpendicular to the surface of the fluorescent tube in a part of the second area is set to the thickness D2, and the thickness of the power acquisition device in the direction perpendicular to the surface of the fluorescent tube in the remaining part of the second area is set to the thickness D1.

6. The power acquisition device according to claim 1, wherein the thickness D2 is a fixed value.

7. The power acquisition device according to claim 1, wherein the thickness D1 is a fixed value.

8. The power acquisition device according to claim 1, wherein the power acquisition device has a cylindrical body having an opening portion through which the fluorescent tube is inserted, and the opening portion is eccentrically located from the center line of the cylindrical body toward the position at which the distance between the surface of the fluorescent tube and the reflective plate becomes minimum.

9. The power acquisition device according to claim 1, wherein the reflective plate has a V-shaped concave portion, and the power acquisition device is formed into a columnar shape having a side surface opposite to the V-shaped concave portion.

10. The power acquisition device according to claim 1, wherein the reflective plate has a V-shaped convex portion, and the power acquisition device has a groove opposite to the V-shaped convex portion.

11. The power acquisition device according to claim 1, comprising at least a magnetic body and a coil.

12. A power acquisition device to be fixed to an illuminating device having a fluorescent tube and a reflective plate so as to acquire power from a magnetic field generated by an alternating current flowing through the fluorescent tube by electromagnetic induction, wherein the power acquisition device is fixed to surround all outer circumference of the fluorescent tube, and at least either a thickness of the power acquisition device in the direction perpendicular to the surface of the fluorescent tube or a length of the power acquisition device in the direction parallel to the length direction of the fluorescent tube is non-uniformly, wherein when the area where the reflective plate exists in the direction perpendicular to the surface of the fluorescent tube is a first area; and the area where the reflective plate does not exist in the direction perpendicular to the surface of the fluorescent tube is a second area, the length of the power acquisition device in the direction parallel to the length direction of the fluorescent tube in at least a part of the first area is larger than the maximum value of the length of the power acquisition device in the direction parallel to the length direction of the fluorescent tube in the second area.

13. The power acquisition device according to claim 1, wherein the length of the power acquisition device in the direction parallel to the length direction of the fluorescent tube in at least a part of the first area is larger than the maximum value of the length of the power acquisition device in the direction parallel to the length direction of the fluorescent tube in the second area.

14. A power acquisition method of a power acquisition device to be fixed to an illuminating device having a fluorescent tube and a reflective plate so as to acquire power from a magnetic field generated by an alternating current flowing through the fluorescent tube by electromagnetic induction, wherein the power acquisition device is fixed to surround the fluorescent tube, and at least either a thickness of the power acquisition device in the direction perpendicular to the surface of the fluorescent tube or a length of the power acquisition device in the direction parallel to the length direction of the fluorescent tube is non-uniformly, and wherein when the area where the reflective plate exists in the direction perpendicular to the surface of the fluorescent tube is a first area; the area where the reflective plate does not exist in the direction perpendicular to the surface of the fluorescent tube is a second area; the minimum distance between the surface of the fluorescent tube and reflective plate in the first area is distance D3; and the thickness of the power acquisition device in the direction perpendicular to the surface of the fluorescent tube at the position at which the distance between the surface of the fluorescent tube and the reflective plate in the first area becomes minimum is thickness D1, the thickness Dl is smaller than the distance D3, and the thickness of the power acquisition device in the direction perpendicular to the surface of the fluorescent tube in at least a part of the second area is set to thickness D2 which is larger than the distance D3.

* * * * *